United States Patent [19]

Bair

[11] Patent Number: 4,668,117

[45] Date of Patent: May 26, 1987

[54] ROD COUPLING WITH MOUNTED GUIDE

[75] Inventor: Michael L. Bair, Orange, Calif.

[73] Assignee: Black Gold Pump & Supply, Inc., Signal Hill, Calif.

[21] Appl. No.: 846,960

[22] Filed: Apr. 1, 1986

[51] Int. Cl.[4] ..... E21B 37/02; B25G 3/34

[52] U.S. Cl. ..... 403/266; 403/267; 403/343; 166/176; 166/241; 175/325

[58] Field of Search ..... 403/265, 266, 268, 269, 403/343, 342, 267; 166/175, 176, 241; 175/325

[56] References Cited

U.S. PATENT DOCUMENTS

| | | | |
|---|---|---|---|
| 1,326,259 | 12/1919 | Gunn et al. | 403/343 X |
| 2,244,104 | 6/1941 | Fitzpatrick | 166/176 |
| 3,058,524 | 10/1962 | Tripplehorn | 166/176 |
| 3,190,191 | 6/1965 | Leman | 403/343 X |
| 3,364,998 | 6/1968 | Sable | 166/176 |
| 3,560,060 | 2/1971 | Morris | 166/241 X |
| 3,664,693 | 5/1972 | Irons | 403/266 |
| 3,747,700 | 7/1973 | Rilling | 175/325 X |
| 3,941,495 | 3/1976 | Duncan | 403/268 X |
| 3,945,446 | 3/1976 | Ostertag et al. | 175/325 X |
| 3,948,575 | 4/1976 | Rosser | 166/241 X |
| 4,050,514 | 9/1977 | Prenn | 166/176 |
| 4,088,185 | 5/1978 | Carson | 166/176 |
| 4,099,564 | 7/1978 | Hutchison | 166/241 |
| 4,182,537 | 1/1980 | Oster | 166/176 X |
| 4,484,833 | 11/1984 | Gallagher | 403/266 X |

FOREIGN PATENT DOCUMENTS

| | | | |
|---|---|---|---|
| 623430 | 7/1961 | Canada | 166/241 |

*Primary Examiner*—Cornelius J. Husar
*Assistant Examiner*—Todd G. Williams
*Attorney, Agent, or Firm*—William W. Haefliger

[57] ABSTRACT

The following structure is connectible to a well sucker rod string:

(a) an axially elongated coupling section having threads at its axially opposite ends for coupling to and between successive sucker rods in the string, to transmit string loading, (b) a rod guide extending about and bonded to the coupling section to project outwardly therefrom for engagement with the well bore during up and down stroking of the string.

The guide typically comprises molded plastic material, is generally annular, and has a bore bonded to the outer surface of the section.

12 Claims, 6 Drawing Figures

ROD COUPLING WITH MOUNTED GUIDE

BACKGROUND OF THE INVENTION

This invention relates generally to well sucker rod guides, and more particularly to improve guides located on coupling sections that may easily be replaced in a rod string.

Sucker rod guides are desirably employed to locally engage the well bore and prevent or minimize engagement of the sucker rods themselves with the well bore. The guides are constructed to abrade or wear away during their sliding engagemeht with the well bore, during rod stroking to pump the well. Problems with such guides include inadvertent and unwanted detachment from the rod string in the well, leading to excessive rod wear and clogging of the well, and equipment therein, by pieces of the guides; and difficulty and expense of guide removal off and replacement onto the string. There is need for guides which are easily and quickly removed and replaced, and which do not become detached from the string during the most adverse stroking conditions, as for example when the well deviates radically from vertical.

SUMMARY OF THE INVENTION

It is a major object of the invention to provide an improved guide, and guide coupling, which will eliminate or minimize the above described problems, as well as others encountered in pumping wells. Basically, the invention comprises (a) an axially elongated coupling section having threads at axially opposite ends thereof for coupling to and between successive sucker rods in the string, to transmit string loading, (b) a rod guide extending about and bonded to said section to project outwardly therefrom, for engagement with the well bore during up and down stroking of the string.

As will be seen, at least one tongue and groove connection may be provided between the guide and coupling section; and typically two such connections may be provided and at opposite ends of the guide, to extend annularly. The guide itself advantageously may consist of molded plastic material, is generally annular, and has a bore bonded to the outer surface of said section; and such plastic most preferably consist of urethane or polyurethane. Further, particulate lubricant such as graphite may be distributed in the molded plastic, to lubricate the rubbing engagement of the guide with the well bore.

It is another feature of the invention that the threads at opposite ends of the coupling section are box threads to facilitate connection, without other couplings, to sucker rod pin ends.

It is a still further feature that the section outer surface to which the guide is bonded has an outer diameter $D_3$ and said section has first and second outwardly exposed surfaces between said guide and opposite ends respectively, of the section, said outwardly exposed surfaces having diameters $D_4$ and $D_5$, and wherein $D_3 < D_4$ and $D_3 < D_5$.

This maintains bonded attachment of the guide to the coupling section despite abrasion of the guide down to the diameters of the sucker rods themselves.

These and other objects and advantages of the invention, as well as the details of an illustrative embodiment, will be more fully understood from the following specification and drawings, in which:

DRAWING DESCRIPTION

Figure 1:
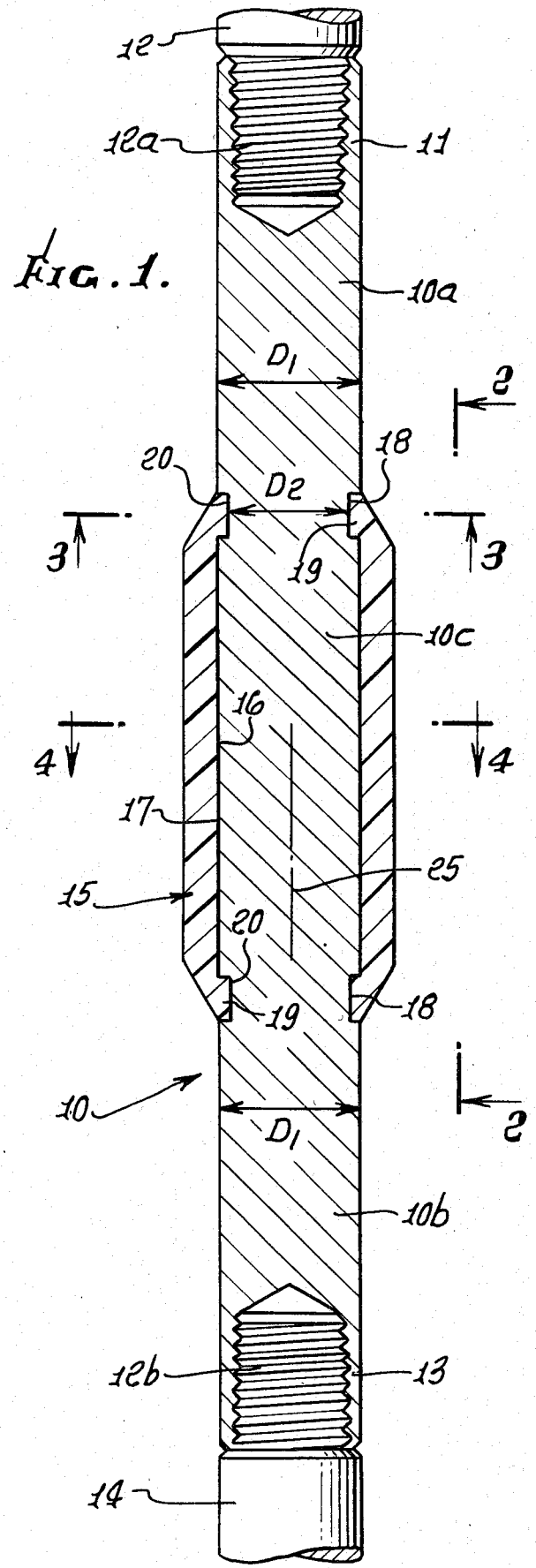
FIG. 1 is a vertical elevation taken in section, to show details of the invention.
Figure 5:
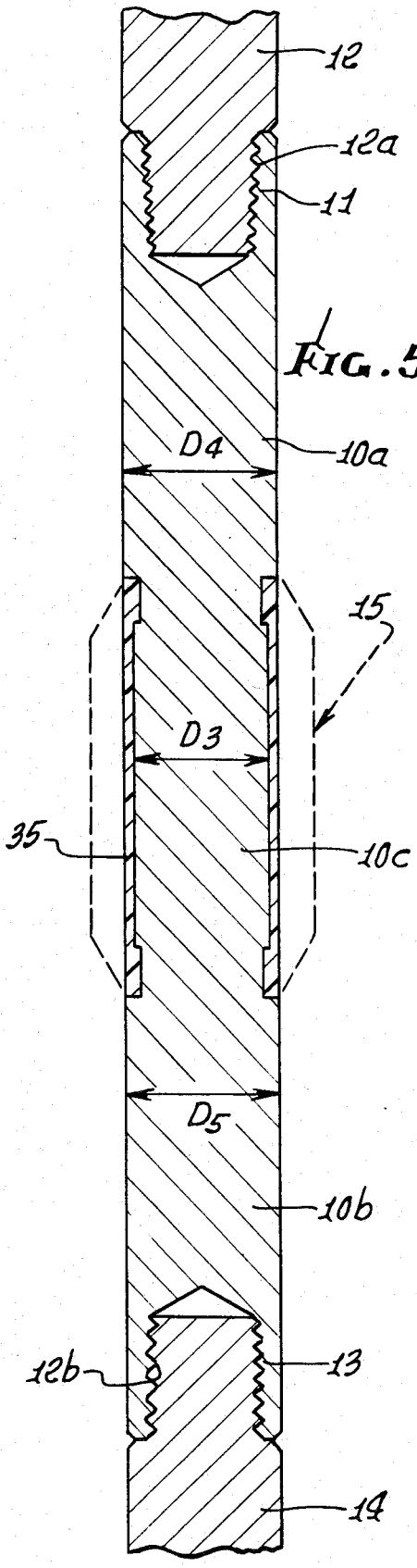
Figure 2:
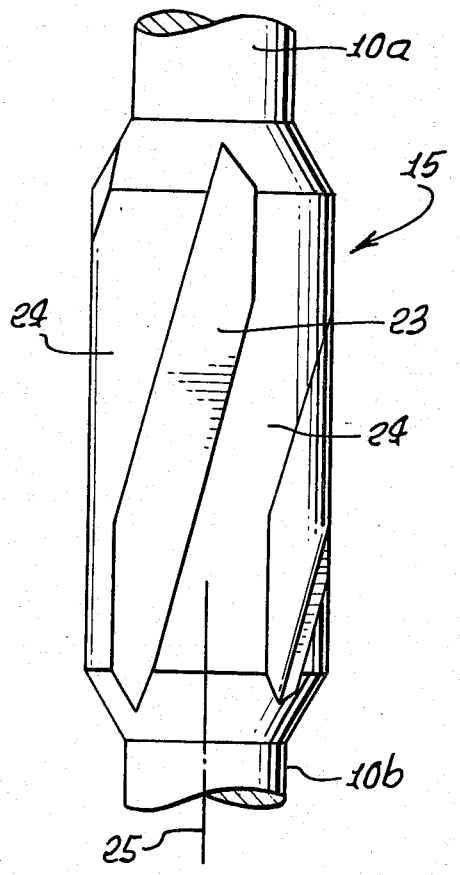
FIG. 2 is a vertical side elevation of a modified coupling and guide.
Figure 3:
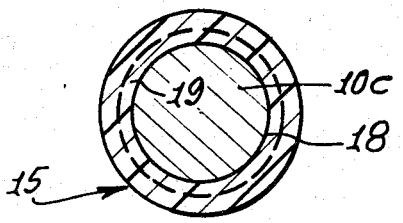
Figure 4:
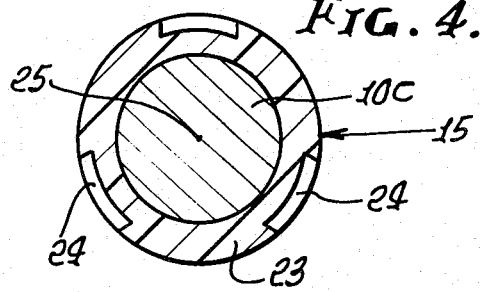

FIG. 3 section on lines 3—3 of FIG. 1;

FIG. 4 is a section on lines 4—4 of FIG. 2;

FIG. 5 is a view like FIG. 1, showing a modification; and

Figure 6:
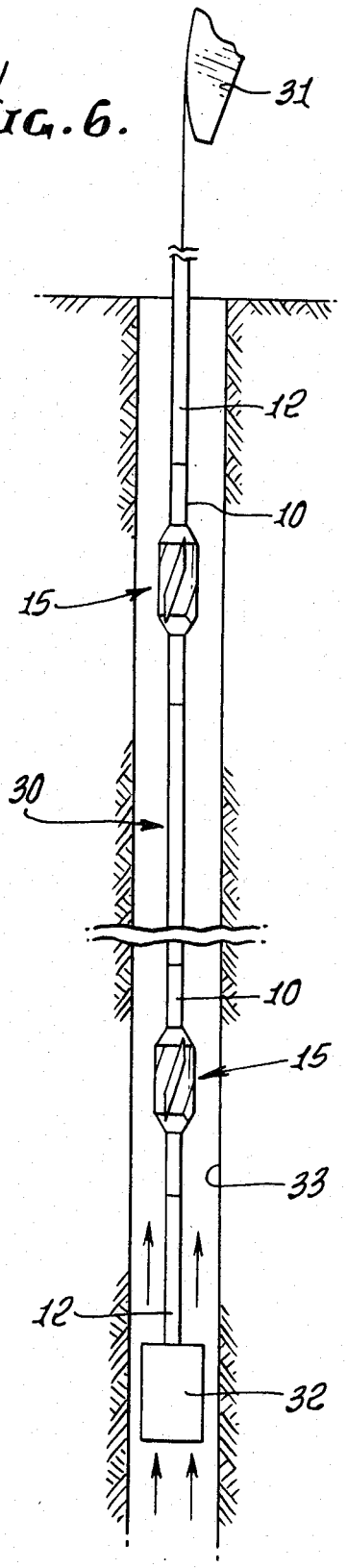

FIG. 6 is an elevation showing a sucker rod string, with couplings therein, incorporating the invention.

DETAILED DESCRIPTION

Referring first to FIGS. 1–4, an axially elongated metallic, as for example steel, coupling section 10 has upper and lower end portions **10*a* and 10*b*, and a mid-portion 10*c*, all of which are cylindrical. Upper portion 10*a* is threaded to attach to a sucker rod section, and preferably such threads are box threads at 11, to threadably receive a threaded pin end 12*a* of the sucker rod upper section 12. Likewise, lower portion 10*b* is threaded to attach to a sucker rod section, and preferably such threads are box threads at 13, to threadably receive a threaded pin end 12*b* of the lower sucker rod section 14. Accordingly, flush surface attachments are made between 10*a* and 12, and between 10*b* and 14, and coupling section 10 directly transmits loading between the rod sections 12 and 14, and it may be easily de-coupled from such sections and replaced, to quickly replace a guide 15**, to be described, as for example after it is worn out.

Further, and as shown, the rod guide 15 extends abut the section mid-portion **10*c*, and is bonded at 16 to the section surface 17, to prevent dislodgement of the guide 15 from the coupling during stroking of the sucker rod string in the well, with the guide 15 frictionally engaging the well bore (as for example casing). At least one tongue and groove connection is provided between the guide 15 and the coupling section 10; and typically two such connections are provided, at opposite ends of the guide. As shown in FIGS. 1 and 3, the tongue and groove connections are preferably annular, and for that purpose annular grooves 18 are sunk in the coupling section 10, at the transitions between portions 10*c* and 10*b*. Annular tongues or ribs 19 integral with the guide 15 are received in the grooves 18 and are bonded to the groove inner surfaces, at 20. The depth of each groove 18 is less than about 15% of the radius of portion 10*a*, i.e. $D_2$ is at least 80% of $D_1$; for example, when diameter $D_1$ is about 158 inches. $D_2$ is preferably about 154 inches, in which event the axial length of each groove 18 is about 178 inch. Accordingly, the tension strength of the coupling 10** is not materially reduced.

The guide 15 consists of molded non-metallic material, such as plastic, one highly advantageous material being urethane or polyurethane. Graphite particulate may be dispersed in the plastic to enhance its surface lubricity at all times as the guide material wears away, or abrades, in use. The guide typically has external flutes 23 defining grooves 24 between successive flutes about the axis 25, as shown in FIG. 2. Three to five such flutes are typically provided i.e. spaced at equal intervals about axis 25, and their depth is less than the wall thickness "t" of the guide. The flutes and grooves typically spiral about axis 25, and the grooves or channels pass well fluid (i.e. lower the resistance to rod string stroking) as the rod string reciprocates up and down. A typical rod string 30 appears in FIG. 6, with guides 15 on couplings 10 interconnecting successive rods 12. Surface equipment 31 reciprocates the string up and down to operate and pump 32 in the well 33.

In the modification shown in FIG. 5, the parts the same as in FIG. 1 bear the same identifying numbers. In this case, the mid-portion 10*c* of the coupling 10 has a diameter $D_3$, and the diameters of portions 10*a* and 10*b* (i.e. at outwardly exposed surfaces of those portions between the guide 15 and the opposite ends of the coupling section) are $D_4$ and $D_5$, $D_4$ normally being equal to $D_5$. $D_3$ is slightly less than each of $D_4$ and $D_5$ (i.e. $D_3 < D_4$ and $D_3 < D_5$), so that in the event of abrasion of the guide down to the diameter $D_4$ or $D_5$, there will still be some guide 35 left surrounding and bonded to the surface of mid-portion 10*c*. This also prevents breakaway of pieces of the guide, from the coupling 10, and which pieces could otherwise clog the well or interfere with other equipment in the well, such as the pump. Preferably, $D_3$ is at least 80% of each of $D_4$ and $D_5$, so that coupling tension strength is not adversely reduced.

The non-metallic material of guide 15 is extremely hard and durable.

I claim:

1. In a well sucker rod string, in a well bore, the combination comprising (a) an axially elongated coupling section having threads at axially opposite ends thereof for coupling to and between successive sucker rods in the rod string, to transmit string loading, said section having first and second exposed surfaces adjacent an end of the section, and a third surface located between said first and second exposed surfaces, (b) a rod guide consisting off molded plastic material extending about and bonded to said section third surface to project outwardly therefrom for engagement with the well bore during up and down stroking of the string, (c) one annular groove sunk in the section between said first and third surfaces, and another annular groove sunk in the section between said second and third surfaces, the depth of said one groove being less than about 15% of the radius of said section at said first surface, and the depth of said other groove being less than about 15% of the radius of said section at said second surface, (d) and said rod guide having integral annular tongues extending radially into and closely fitting said recesses, at opposite ends of the rod guide, (e) the length of each groove axially of the section being substanially greater than said depth of the groove.

2. The combination of claim 1 wherein said threads at opposite ends of the section are box threads.

3. The combination of claim 1 wherein said rod guide has flutes thereon defining grooves therebetween, the grooves extending lengthwise of the section.

4. The combination of claim 3 wherein said flutes and grooves spiral about the axis of the section.

5. The combination of claim 1 including sucker rods of said string thread connected to said section threads.

6. The combination of claim 5 including multiple combinations as defined in claim 1 connected into a sucker rod string and between successive rods of the string.

7. The combination of claim 1 wherein said rod guide has a bore bonded to the outer surface of said section.

8. The combination of claim 7 wherein said plastic material consists of urethane or polyurethane.

9. The combination of claim 8 including particulate lubricant distributed in said plastic material.

10. The combination of claim 9 wherein said lubricant consists of graphite.

11. The combination of claim 7 wherein said first and second exposed surfaces have first ($D_4$) and second ($D_5$) diameters, respectively, and said third surface has a third diameter ($D_3$), such that said third diameter ($D_3$) is less than each of said first ($D_4$) and second ($D_5$) diameters.

12. The combination of claim 11 wherein said third diameter ($D_3$) is as least 80% of said first diameter ($D_4$), and said third diameter ($D_3$) is also at least 80% of said second diameter ($D_5$).

* * * * *